US006744206B2

(12) United States Patent
Miura et al.

(10) Patent No.: US 6,744,206 B2
(45) Date of Patent: Jun. 1, 2004

(54) METAL HALIDE LAMP WITH REDUCED CHANGE IN COLOR TEMPERATURE

(75) Inventors: Mikio Miura, Takatsuki (JP); Shunsuke Kakisaka, Ibaraki (JP); Yoshiharu Nishiura, Otsu (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/373,007

(22) Filed: Feb. 24, 2003

(65) Prior Publication Data

US 2003/0173901 A1 Sep. 18, 2003

(30) Foreign Application Priority Data

Feb. 25, 2002 (JP) ..... 2002-047437

(51) Int. Cl.[7] ..... H01J 17/16

(52) U.S. Cl. ..... 313/634; 313/491; 313/493; 313/620

(58) Field of Search ..... 313/491, 493, 313/573, 620, 634, 631

(56) References Cited

U.S. PATENT DOCUMENTS

| | | | |
|---|---|---|---|
| 4,475,061 | A | 10/1984 | van de Weijer et al. |
| 6,469,442 | B2 | 10/2002 | Kakisaka et al. |

FOREIGN PATENT DOCUMENTS

| | | |
|---|---|---|
| JP | 57-78763 | 5/1982 |
| JP | 2000-100386 | 4/2000 |
| JP | 2000-340171 | 12/2000 |

*Primary Examiner*—Vip Patel

(57) ABSTRACT

A metal halide lamp includes: an arc tube having a light-emitting unit forming a discharge space therein, and two thin-tube units fitted into openings in both ends of the light-emitting unit; two electrode holding members provided through the thin-tube units so that one ends hold the electrodes and the other ends extend from one ends of the thin-tube units not facing the discharge space, and sealed to the thin-tube units via sealing members; and a metal tubular member through which the electrode and/or electrode holding member is inserted within the thin-tube units. Expressions "$X \geqq 0.0056P+0.194$" and "$0 \leqq L \leqq 0.44X$" are satisfied, where "P" is lamp wattage [W], "X" distance [mm] from one end of the thin-tube unit facing the discharge space to one end of the coil facing the thin-tube unit, and "L" length [mm] of a part of the tubular member protruding into the discharge space.

14 Claims, 15 Drawing Sheets

FIG.7

250W L=0.1

| X | △Tc(3000h) | EVALUATION |
|---|---|---|
| 0.8 | 330K | × |
| 1.3 | 355K | × |
| 1.5 | 322K | × |
| 1.6 | 68K | ○ |
| 1.8 | 60K | ○ |
| 2.3 | 65K | ○ |

FIG.8

70W L=0.1

| X | △Tc(3000h) | EVALUATION |
|---|---|---|
| 0.4 | 343K | × |
| 0.5 | 432K | × |
| 0.6 | 40K | ○ |
| 0.8 | 55K | ○ |
| 1.0 | 30K | ○ |

FIG.10

250W

| L(mm) | △Tc(3000h) | EVALUATION |
|---|---|---|
| -0.2 | 330K | × |
| -0.1 | 328K | × |
| 0 | 181K | ○ |
| 0.5 | 50K | ○ |

FIG.11

70W

| L(mm) | △Tc(3000h) | EVALUATION |
|---|---|---|
| -0.2 | 343K | × |
| -1.0 | 331K | × |
| 0 | 186K | ○ |
| 0.2 | 46K | ○ |

FIG.12

250W

| L(mm) | PROBABILITY OF BACK ARC |
|---|---|
| 0 | 0/10 |
| 0.1 | 0/10 |
| 0.5 | 0/10 |
| 0.7 | 0/10 |
| 0.8 | 2/10 |
| 0.9 | 3/10 |

FIG.13

70W

| L(mm) | PROBABILITY OF BACK ARC |
|---|---|
| 0 | 0/10 |
| 0.1 | 0/10 |
| 0.2 | 0/10 |
| 0.25 | 0/10 |
| 0.3 | 2/10 |
| 0.4 | 3/10 |

METAL HALIDE LAMP WITH REDUCED CHANGE IN COLOR TEMPERATURE

BACKGROUND OF THE INVENTION (1) Field of the Invention

The present invention relates to metal halide lamps, and in particular relates to a metal halide lamp that uses an arc tube made of alumina ceramic.

(2) Related Art

In recent years, arc tubes made of alumina ceramic have become mainstream ones for use in metal halide lamps, replacing conventional silica glass arc tubes. Alumina ceramic has higher heat-proof properties than silica glass, and therefore is a suitable material for arc tubes used in such high-pressure discharge lamps as metal halide lamps, which reach high temperatures during lighting.

The temperature of such a metal halide lamp using an alumina ceramic arc tube can be raised to high during lighting of the lamp. Therefore, the lamp is enabled to exhibit higher color rendition and higher luminous efficiency.

Further, alumina ceramic has a lower reactivity to metal halide enclosed in an arc tube than silica glass. With the use of such alumina ceramic arc tubes, therefore, metal halide lamps are expected to have a longer life.

Here, a method for sealing electrodes in this type of lamp is different from a sealing method employed for a lamp using a silica glass arc tube. The sealing method employed for the silica glass arc tube is to seal electrodes by heating and crushing ends of side-tube parts of the arc tube. Unlike this method, the sealing method employed for the alumina ceramic arc tube is to first insert a power feeding member into a space formed within each of two thin-tube parts, and then inject a melted sealing material, e.g., a glass frit, into the space, thereby sealing the power feeding member in each thin-tube part. According to this method, however, the power feeding member and the thin-tube part are sealed only at the end of each thin-tube part not facing the discharge space via the sealing material, and the unsealed area results in a gap between the power feeding member and the thin-tube part (see e.g., Japanese Laid-open Patent Application No. S57-78763). Such a gap is inevitably large for a large-size lamp with a high wattage.

As described above, a conventional metal halide lamp that uses an alumina ceramic arc tube has gaps between its power feeding members and thin-tube parts of the arc tube. When this conventional lamp is lit with the electrodes being oriented in the vertical direction, a light-emitting metal enclosed within the arc tube is likely to flow into the gap in the lower one of the thin-tube parts in the vertical direction.

If a portion of the light-emitting metal flows into the gap during a test-life of the lamp (hereafter simply a "life") the amount of metal contributing to light emission in the discharge space decreases accordingly. If this happens, a sufficiently high vapor pressure cannot be obtained. The lamp then suffers from the problem that its color temperature changes greatly as the lamp is lit for long hours.

To solve such problems, Japanese Laid-open Patent Application No. 2000-340171 discloses the lamp construction where, in each thin-tube part, at least a predetermined distance is provided between (a) one end of the thin-tube part facing the discharge space and (b) the electrode coil.

FIG. 1 shows a metal halide lamp with the conventional construction according to the disclosure. This metal halide lamp is made up of a light-emitting unit 102, thin-tube units 103*a* and 103*b*, a pair of electrodes 105*a* and 105*b*, electrode holding members 106*a* and 106*b*, and sealing members 107*a* and 107*b*. The light-emitting unit 102 is made of translucent ceramic and in which a discharge space 101 is formed. In the discharge space 101, a light-emitting metal is enclosed. The thin-tube units 103*a* and 103*b* are respectively provided at both ends of the light-emitting unit 102. The pair of electrodes 105*a* and 105*b* respectively have coils 104*a* and 104*b* at their tops. The electrode holding members 106*a* and 106*b* respectively hold the electrodes 105*a* and 105*b* at their one ends. The other ends of the electrode holding members 106*a* and 106*b* extend from the ends of the thin-tube units 103*a* and 103*b* not facing the discharge space 101. The sealing members 107*a* and 107*b* are respectively provided to seal the electrode holding members 106*a* and 106*b* to the thin-tube units 103*a* and 103*b*. According to the disclosure, the metal halide lamp is to be constructed to satisfy the condition "X>0.0056P+0.394", where "P [W]" represents a lamp wattage, and "X [mm]" represents a distance from one end of the coil 104*a* (104*b*) facing the thin-tube unit 103*a* (103*b*) to one end of the thin-tube unit 103*a* (103*b*) facing the discharge space 1.

By satisfying this condition, the temperature of the ends of the thin-tube units 103*a* and 103*b* facing the discharge space can be lowered to such a degree that an excess of light-emitting metal enclosed in the discharge space can exist in a liquid form therein. Therefore, the amount of light-emitting metal flowing into the gaps in each thin-tube unit can be reduced, thereby reducing the color temperature change.

According to the above disclosure, however, means for occupying the gap "λ" formed within each of the thin-tube units 103*a* and 103*b* is not provided. Even if a certain conventional technique provides a member as this means for occupying the gap "λ", the member is entirely embedded in a thin-tube unit so as to be recessed from the end of the thin-tube unit, and fails to prevent a light-emitting metal from easily flowing info the gap "λ", thereby failing to prevent the color temperature from being greatly changed after continuous lighting of long hours.

SUMMARY OF THE INVENTION

The present invention therefore aims at providing a metal halide lamp that exhibits stable characteristics with a reduced change in the color temperature even after continuous lighting of long hours, by reducing the amount of light-emitting metal flowing into gaps formed in thin-tube units of an arc tube.

The above aim can be achieved by a metal halide lamp, including: a bulb that is made up of a light-emitting unit in which a discharge space is formed, and a pair of thin-tube units each being fitted into an opening in a different one of both ends of the light-emitting unit; a pair of electrodes that extend into the discharge space so that tops thereof are opposed to each other, each electrode having an electrode coil at a top part thereof; a pair of electrode holding members each being provided through a different one of the thin-tube units so that one end thereof holds the electrode and the other end thereof extends from one end of the thin-tube unit not facing the discharge space, each electrode holding member being sealed to the thin-tube unit via a sealing member; a tubular member that is provided in at least one of the thin-tube units, so that the electrode and/or the electrode holding member therein is inserted through the tubular member, the tubular member being made of a heat-proof and heat-conductive material, wherein the expressions "$X \geqq 0.0056P+0.194$" and "$0 \leqq L \leqq 0.44X$" are satisfied, where "P" is a lamp wattage [W], "X" is a distance [mm] from one end of the thin-tube unit facing the discharge space to one end of the electrode coil facing the thin-tube unit, and "L" is a length [mm] of a part of the tubular member protruding from the end of the thin-tube unit facing the discharge space into the discharge space.

The above aim can also be achieved by a metal halide lamp, including: a bulb that is integrally made up of a light-emitting unit in which a discharge space is formed, and a pair of thin-tube units; a pair of electrodes that extend into the discharge space so that tops thereof are opposed to each other, each electrode having an electrode coil at a top part thereof; a pair of electrode holding members each being provided through a different one of the thin-tube units so that one end thereof holds the electrode and the other end thereof extends from one end of the thin-tube unit not facing the discharge space, each electrode holding member being sealed to the thin-tube unit via a sealing member; a tubular member that is provided in at least one of the-thin-tube units, so that the electrode and/or the electrode holding member therein is inserted through the tubular member, the tubular member being made of a heat-proof and heat-conductive material, wherein the expressions "$X \geqq 0.0056P+0.194$" and "$0 \leqq L \leqq 0.44X$" are satisfied, where "P" is a lamp wattage [W], "X" is a distance [mm] from a reference position to one end of the electrode coil facing the thin-tube unit, and "L" is a length [mm] of a part of the tubular member protruding from the reference position into the discharge space, the reference position being a position on a joining part of the light-emitting unit joining each thin-tube unit thereto, where an inner diameter of the joining part is 1.25 times an inner diameter of the thin-tube unit.

According to the above construction, when the metal halide lamp is lit with the electrodes in the arc tube being oriented in the vertical direction, the temperature of one ends of the thin-tube units facing the discharge space can be lowered to such a degree that an excess of light-emitting metal can exist in a liquid form. Also, the tubular member is embedded at a predetermined position in one or both of the thin-tube units so as to occupy its opening. Therefore, the light-emitting metal in a liquid form can be collected in such an area from which it is less likely to enter into the thin-tube unit Therefore, the amount of light-emitting metal flowing into the thin-tube unit can be reduced.

As a result of this, the metal halide lamp can maintain a sufficiently high vapor pressure within its discharge space and therefore can maintain stable characteristics with a reduced change in its color temperature even after continuous lighting of long hours.

Further, the tubular member is set in such a manner that the length of its part protruding into the discharge space does not exceed a predetermined value with respect to the distance "X". Therefore, an arc discharge can be prevented from starting from the tubular member at the lamp startup.

BRIEF DESCRIPTION OF THE DRAWINGS

These and other objects, advantages and features of the invention will become apparent from the following description thereof taken in conjunction with the accompanying drawings that illustrate a specific embodiment of the invention.

In the drawings:

FIG. 7 is a table showing the relationship between the distance "X" and the color temperature change shown in the graph in FIG. 5;

FIG. 8 is a table showing the relationship between the distance "X" and the color temperature change shown in the graph in FIG. 6;

FIG. 10 is a table showing the relationship, in 250 W metal halide lamps, between (a) the length "L" of a part of a tubular member set on an electrode pin protruding into a discharge space (b) and the color temperature change;

FIG. 11 is a table showing the relationship, in 70 W metal halide lamps, between (a) the length "L" of a part of a tubular member set on an electrode pin protruding into a discharge space and (b) the color temperature change;

FIG. 12 is a table showing the probability of back arc in metal halide lamps (250 W) with the construction shown in FIGS. 2 and 3, each lamp varying in the length "L" of a part of each tubular member protruding into a discharge space;

FIG. 13 is a table showing the probability of back arc in metal halide lamps (70 W) with the construction shown in FIGS. 2 and 3, each lamp varying in the length "L" of a part of each tubular member protruding into a discharge space;

DESCRIPTION OF THE PREFERRED EMBODIMENT

The following describes a preferred embodiment of the present invention in detail, with reference to the drawings.

Figure 1:
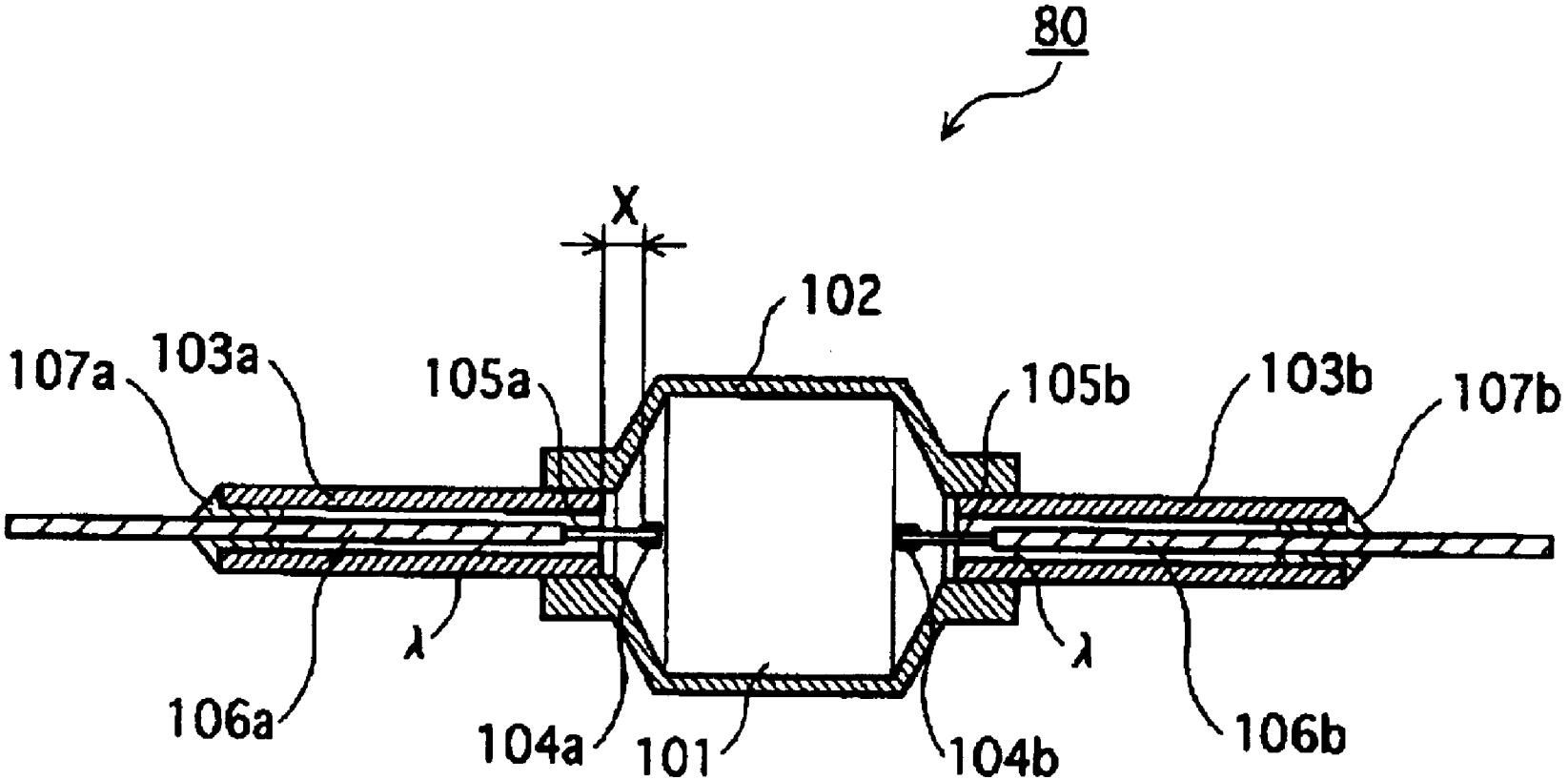
FIG. 1 is a cross sectional view showing the construction of an arc tube included in a conventional metal halide lamp.
Figure 2:
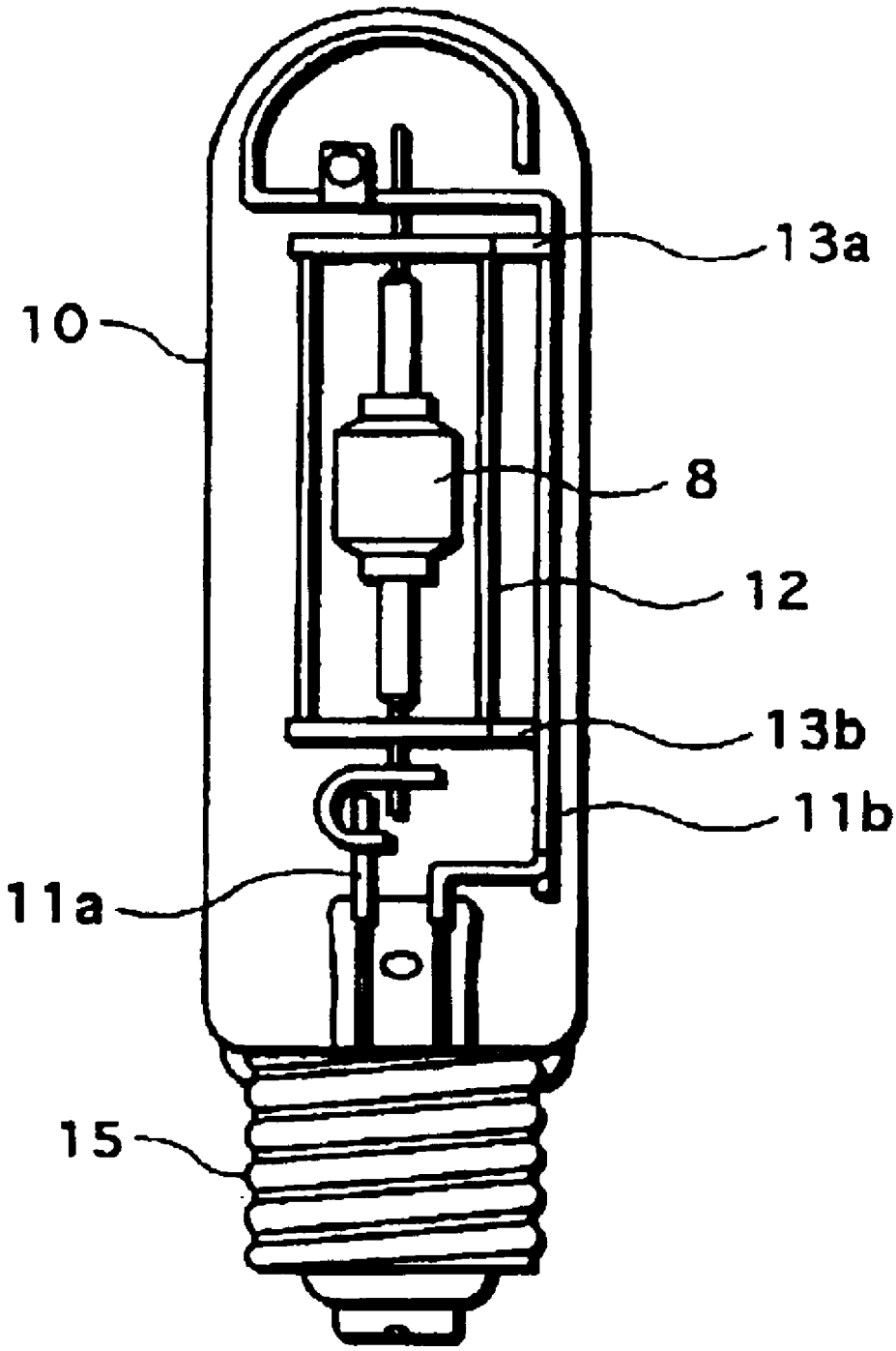
FIG. 2 is a front view showing the construction of a metal halide lamp relating to a preferred embodiment of the present invention.

FIG. 2 is a front view showing the construction of a 250 W metal halide lamp relating to the preferred embodiment of the present invention.

As shown in the figure, the metal halide lamp is made up of an alumina ceramic arc tube 8 that is supported at a predetermined position by power feeding lines 11*a* and 11*b* within an outer tube 10.

Within the outer tube 10, nitrogen is enclosed at a predetermined pressure. A base 15 is attached to the outer tube 10 in the vicinity of the sealing part.

The arc tube 8 is placed within a sleeve 12 made of silica glass that has the effect of cutting ultraviolet rays. The silica glass sleeve 12 is provided to retain heat in the arc tube 8 to provide a sufficiently high vapor pressure, and also to protect the outer tube 10 against damage in case the arc tube 8 is broken. The silica glass sleeve 12 is supported by the power feeding lines 11*a* and 11*b* via sleeve supporting plates 13*a* and 13*b*.

Figure 3:
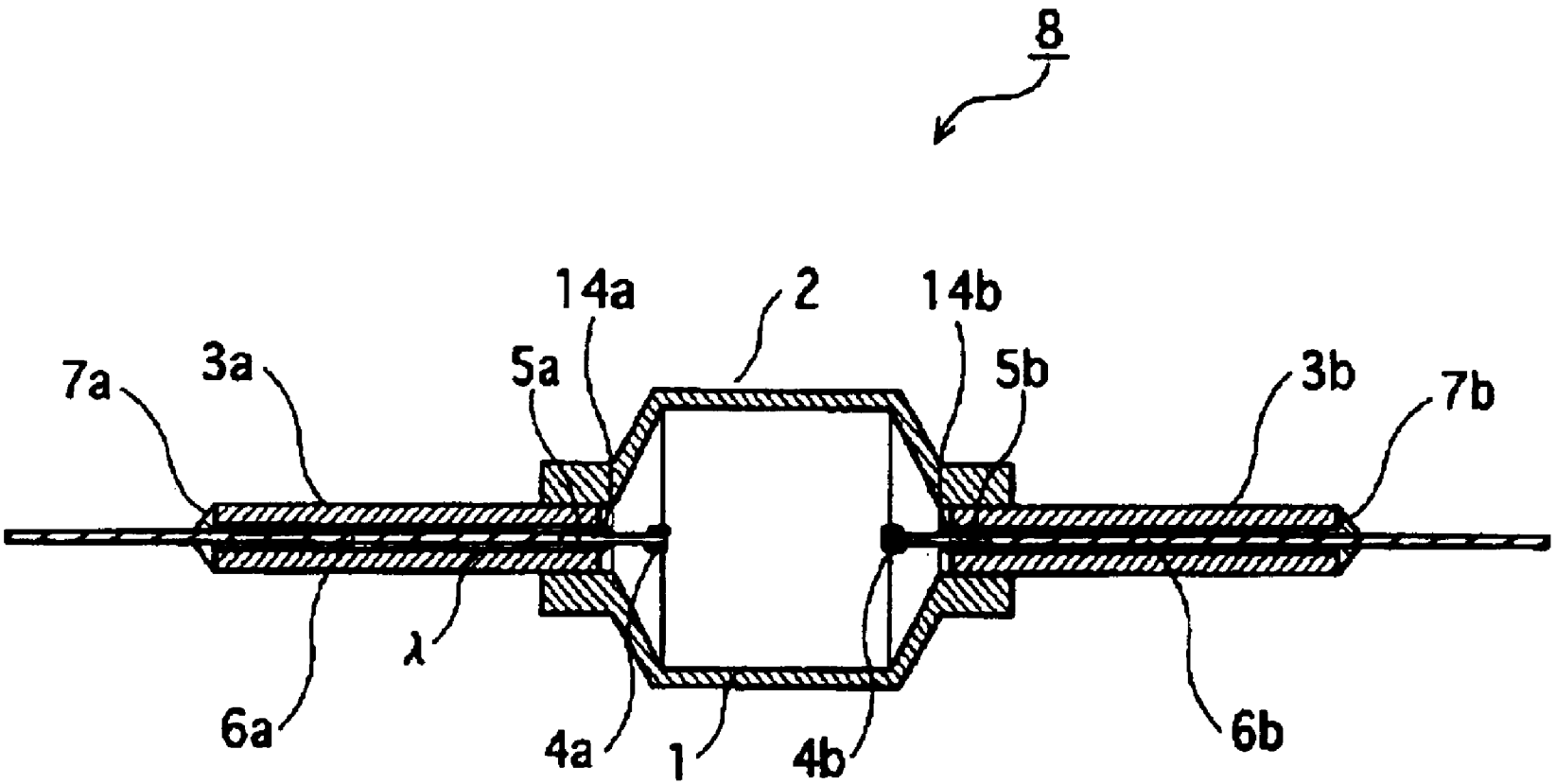
FIG. 3 is a cross sectional view showing the construction of an arc tube included in the metal halide lamp shown in FIG. 2.

FIG. 3 is a cross sectional view showing the construction of the arc tube 8. As shown in FIG. 3, a bulb for the arc tube 8 is constructed by fitting one ends of thin-tube units 3*a* and 3*b* into openings provided in both end parts with smaller diameter of a light-emitting unit 2, and shrinkage-fitting the one ends of the thin-tube units 3*a* and 3*b* to the end parts of the light-emitting unit 2. In the light-emitting unit 2, a discharge space 1 is formed.

In the discharge space 1, mercury, a rare gas, and a light-emitting metal are enclosed.

In the thin-tube units 3*a* and 3*b*, a pair of power feeding members made up of a pair of electrode pins 5*a* and 5*b* having electrode coils 4*a* and 4*b* at their tops and a pair of electrode holding members 6*a* and 6*b* respectively holding the electrode pins 5*a* and 5*b* at their one ends are provided in such a manner that the coils 4*a* and 4*b* face each other within the discharge space 1.

At the base ends of the electrode pins 5*a* and 5*b*, tubular members 14*a* and 14*b* that are coil members are set, in such a manner that the electrode pins 5*a* and 5*b* are inserted through the tubular members 14*a* and 14*b*. These tubular members 14*a* and 14*b* are mostly embedded in the thin-tube units 3*a* and 3*b*, except their top parts. The tubular members 14*a* and 14*b* function to block a light-emitting metal flowing into the thin-tube units 3*a* and 3*b*.

The electrode pins 5*a* and 5*b* are made of a tungsten material, and have an outer diameter of 0.71 mm and a length of 5.2 mm.

Also, the electrode holding members 6*a* and 6*b* have an outer diameter of 1.2 mm and a length of 30 mm. In the present embodiment, the electrode holding members 6*a* and 6*b* are made, for example, of conductive cermet obtained by mixing and sintering molybdenum and alumina. The thermal expansion coefficient of the conductive cermet is $7.0\times10^{-6}$, which is substantially the same as that of alumina. Therefore, cracking of the arc tube often caused by a difference in the thermal expansion coefficient is unlikely to occur.

One ends of the electrode holding members 6*a* and 6*b* less closer to the discharge space extend from one ends of the thin-tube units 3*a* and 3*b* not facing the discharge space. The thin-tube units 3*a* and 3*b* have an inner diameter of 1.3 mm. The electrode holding members 6*a* and 6*b* are sealed to the thin-tube units 3*a* and 3*b* via sealing members 7*a* and 7*b*.

The sealing members 7*a* and 7*b* are made, for example, of a glass frit containing metal oxide, alumina, and silica. The sealing members 7*a* and 7*b* are embedded into the ends of the thin-tube units 3*a* and 3*b* that are opposite to their ends fitted to the light-emitting unit 2, by a predetermined length toward the light-emitting unit 2.

Figure 4:
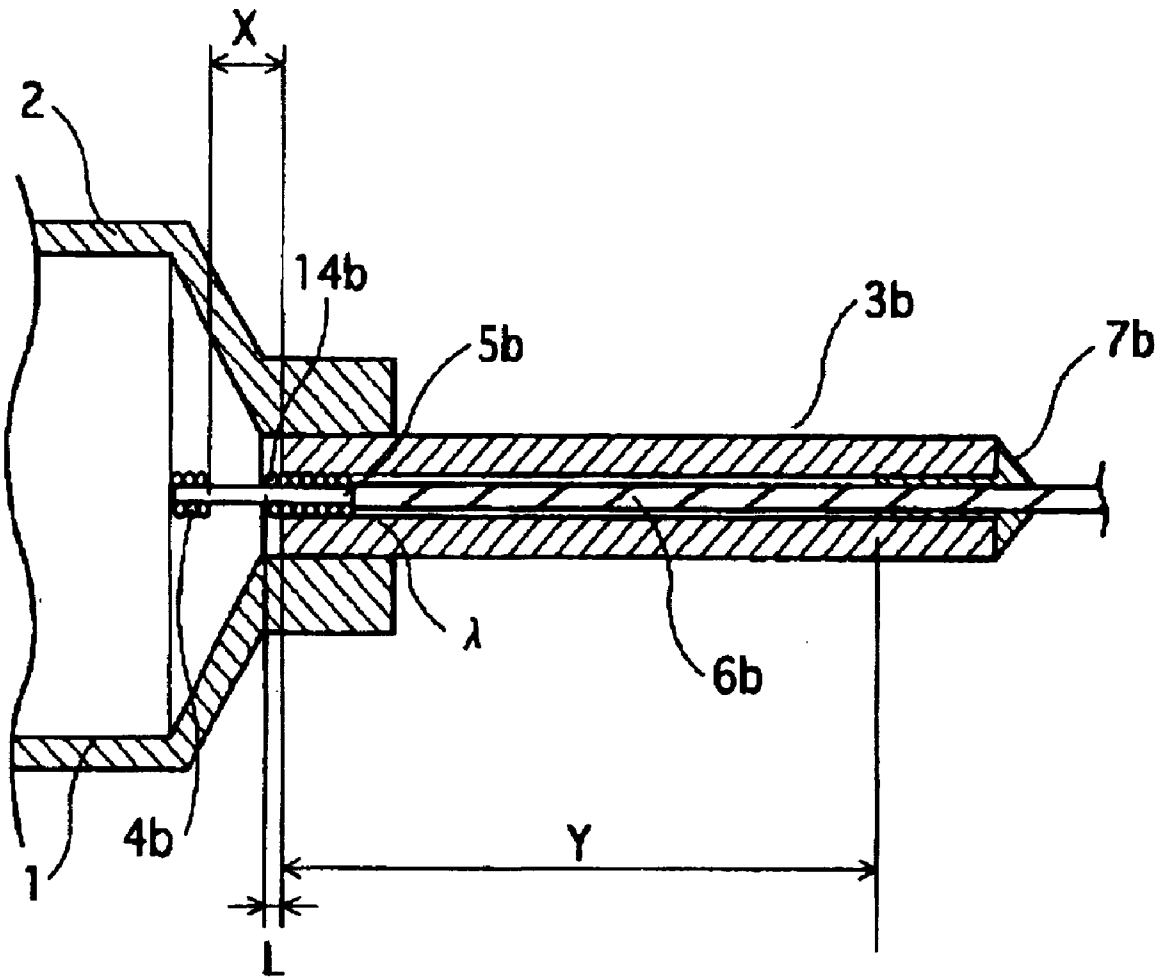
FIG. 4 is a partially enlarged cross sectional view showing one thin-tube unit of the arc tube in FIG. 3.

FIG. 4 is a partially enlarged cross sectional view showing the state of the thin-tube unit 3*b*, the electrode holding member 6*b* provided therein, the electrode pin 5*b*, and the electrode coil 4*b* shown in FIG. 3.

The tubular member 14*b* is a coil made by densely turning a molybdenum wire with a diameter of 0.25 mm, in such a manner that gaps are not formed between adjacent turns. The length of the tubular member 14*b* in the tube axis direction is 2.5 mm. One end of the tubular member 14*b* not facing the discharge space is substantially in contact with the end of the electrode holding member 6*b*, for the purpose of minimizing the volume of the gap "λ" into which the liquefied metal halide flows.

Also, the tubular member 14*b* is fitted in the thin-tube unit 3*b*, with a clearance provided between them being in a range of 0.005 to 0.2 mm. More specifically, it is preferable that the inner diameter of the thin-tube unit 3*b* is larger than the outer diameter of the tubular member 14*b* by 0 to 0.1 mm. With the tubular member 14*b* fitted in the thin-tube unit 3*b* having such a narrow clearance being provided between them, the light-emitting metal can be prevented from flowing into the thin-tube unit 3*b*. Also, the tubular member 14*b* is unlikely to move to a wrong position after the assembly.

It should be noted here that the thin-tube unit 3*a* has the same construction as the thin-tube unit 3*b* shown in FIG. 4.

Here, in the metal halide lamp having the above construction, the distance from one end of the electrode coil 4*b* (4*a*) facing the thin-tube unit 3*b* (3*a*) to one end of the thin-tube unit 3*b* (3*a*) facing the discharge space 1 is assumed to be the distance "X" (see FIG. 4), and the length of a part of the tubular member 14*b* (14*a*) protruding from the end of the thin-tube unit 3*b* (3*a*) facing the discharge space into the discharge space is assumed to be the length "L". The inventors of the present application conducted a number of tests by setting the distance "X" and the length "L" at various values, to see how the distance "X" and the length "L" affect the temperature color change caused by the above described flowing of the light-emitting metal into the gaps. The inventors could finally find out the optimum ranges of values for the distance "X" and the length "L", with which the change in the color temperature can be reduced.

The following describes the optimum ranges of values for the distance "X" and the length "L".

(1) Optimum Range for Distance "X"

Figure 5:
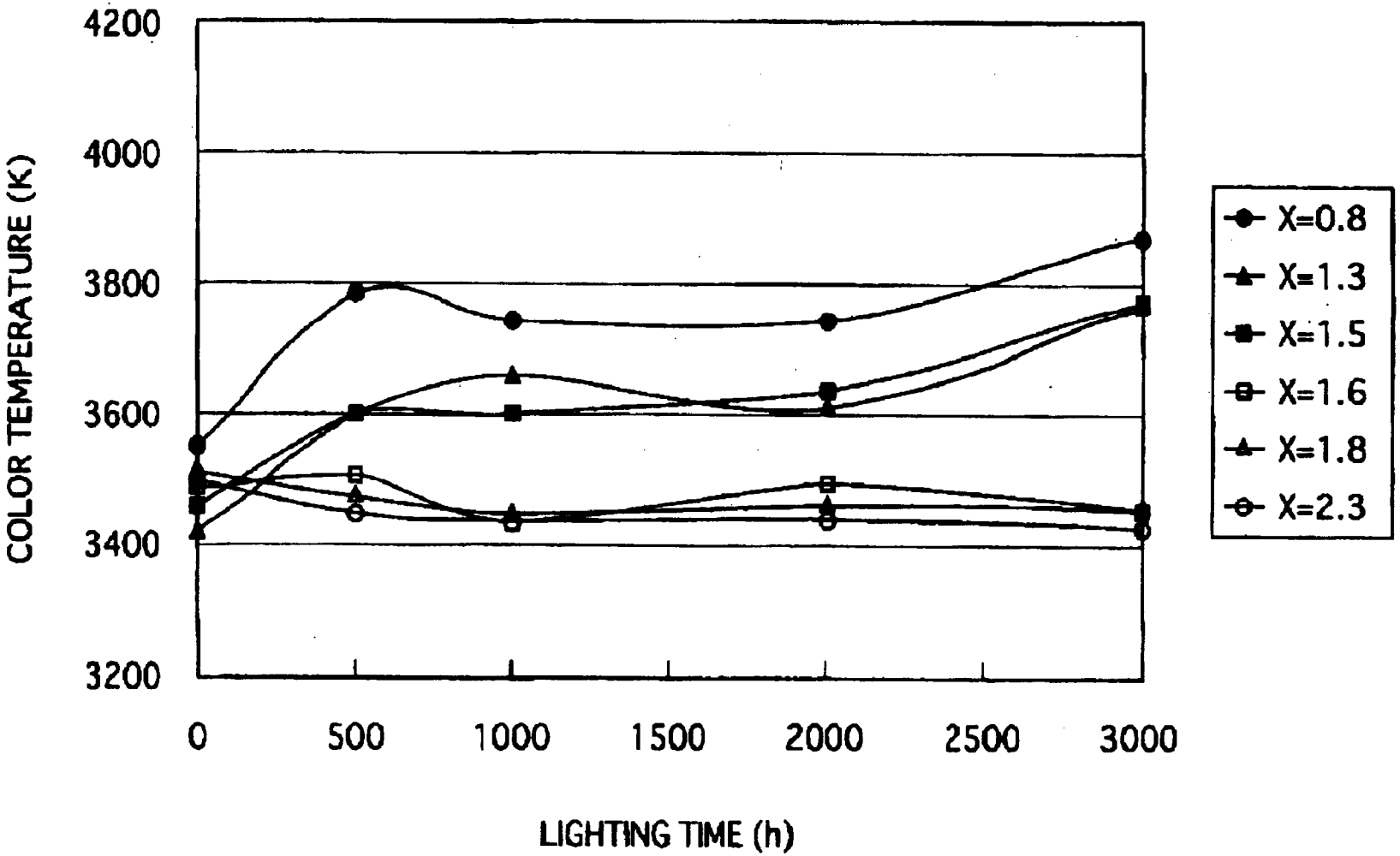
FIG. 5 is a graph showing a change in the color temperature in metal halide lamps (250 W) with the construction shown in FIGS. 2 and 3, each lamp varying in the distance "X" from one end of the coil facing the thin-tube unit to one end of the thin-tube unit facing the discharge space.

First, a lighting test was conducted on 250 W metal halide lamps with the construction shown in FIGS. 2 and 3, for the purpose of finding an optimum range of values for the distance For this test, a plurality of 250 W test lamps were prepared, with the distance "X" being set at various values, namely, 0.8 mm, 1.3 mm, 1.5 mm, 1.6 mm, 1.8 mm, and 2.3 mm. For each lamp, a change in its color temperature during the life (after lighting of 3000 hours) was measured. The test results are shown in FIG. 5.

It should be noted here that the other specifications of each test lamp were uniformly set in the following way.

The length "L" of parts of the tubular members 14*a* and 14*b* protruding into the discharge space 1 was uniformly set at 0.1 mm.

The amount of light-emitting metal enclosed into the discharge space 1 was uniformly set at 5.2 mg. The light-emitting metal composed of 0.8 mg of $DyI_3$, 0.6 mg of $HoI_3$, 0.8 mg of $TmI_3$, 2.2 mg of NaI, and 0.8 mg of TlI was used. Within the discharge space 1, 20 kPa of argon was enclosed as a rare gas.

The distance, "Y" (see FIG. 4) from one ends of the thin-tube units 3*a* and 3*b* facing the discharge space 1 to one ends of the glass frit sealing members 7*a* and 7*b* closer to the discharge space 1 was uniformly set at 18 mm.

It should be noted here that the lighting test was conducted on each test lamp, by lighting the test lamp continuously for 3000 hours with the tube axis being oriented in the vertical direction (the same method is applied to the other tests described later).

FIG. 7 is a table showing the color temperature change (ΔTc) after 3000 hours of lighting. The table shows values of the color temperature change that are derived from the test results in FIG. 5, together with their evaluation.

As can be known from the figure showing the case of 250 W test lamps with the length "L" being 0.1 mm, the color temperature change during the life is extremely small for the lamps with the distance "X" being 1.6 mm or more.

These results can be explained as follows. By setting the distance "X" at 1.6 mm or more, one ends of the thin-tube units 3*a* and 3*b* facing the discharge space 1 can be kept sufficiently away from a high temperature positive column and also from high temperature top parts of the electrode pins 5*a* and 5*b* including the electrode coils 4*a* and 4*b*. Further, the temperature of the ends of the thin-tube units 3*a* and 3*b* facing the discharge space 1 can be lowered. This, in combination with the effect produced by the tubular members 14*a* and 14*b*, contributes to reducing the color temperature change to a permissible level.

To be more specific, a plurality of factors described below are considered to contribute to reducing the color temperature change. The tubular members 14*a* and 14*b* occupy the openings of the thin-tube units 3*a* and 3*b* provided at one ends thereof facing the discharge space. These tubular members 14*a* and 14*b* function to block a light-emitting metal, particularly in a liquid form, flowing into the gaps "λ" that are formed between the thin-tube units 3*a* and 3*b* and the electrode holding members 6*a* and 6*b*. Moreover, the ends of the thin-tube units 3*a* and 3*b* are kept sufficiently away from the electrode tops. Also, the tubular members 14*a* and 14*b* are coil members made of conductive metal and so have high heat dissipation properties. Due to these, the temperature in the vicinity of the ends of the thin-tube units 3*a* and 3*b* facing the discharge space 1 can be lowered to such a degree that an excess of metal can exist in a liquid form therein. This means that vaporized metal is liquefied at the ends of the thin-tube units 3*a* and 3*b* facing the discharge space 1 before permeating into the gaps "A". These factors in combination are considered to reduce, to a permissible level, the amount of light-emitting metal flowing into the gaps "A" formed within the thin-tube units 3*a* and 3*b*.

As a result of this, a sufficiently high vapor pressure can be maintained within the arc tube 8. Also, as compared with conventional lamps in which the tubular members 14*a* and 14*b* are not provided (with the distance "X" being 1.8 mm and the distance "Y" being 18 mm), the color temperature change of the above lamps measured for example during lighting of 1000 hours was reduced to about a half or one third of that of the conventional lamps.

Further, the above lamps with the distance "X" being 1.6 mm or more showed the color temperature change during lighting of 3000 hours being substantially comparable to the color temperature change during lighting of 1000 hours. In this way, the color temperature change during the life can be substantially eliminated.

Next, the same test was conducted on 70 W metal halide lamps with the construction shown in FIGS. 2 and 3.

Figure 6:
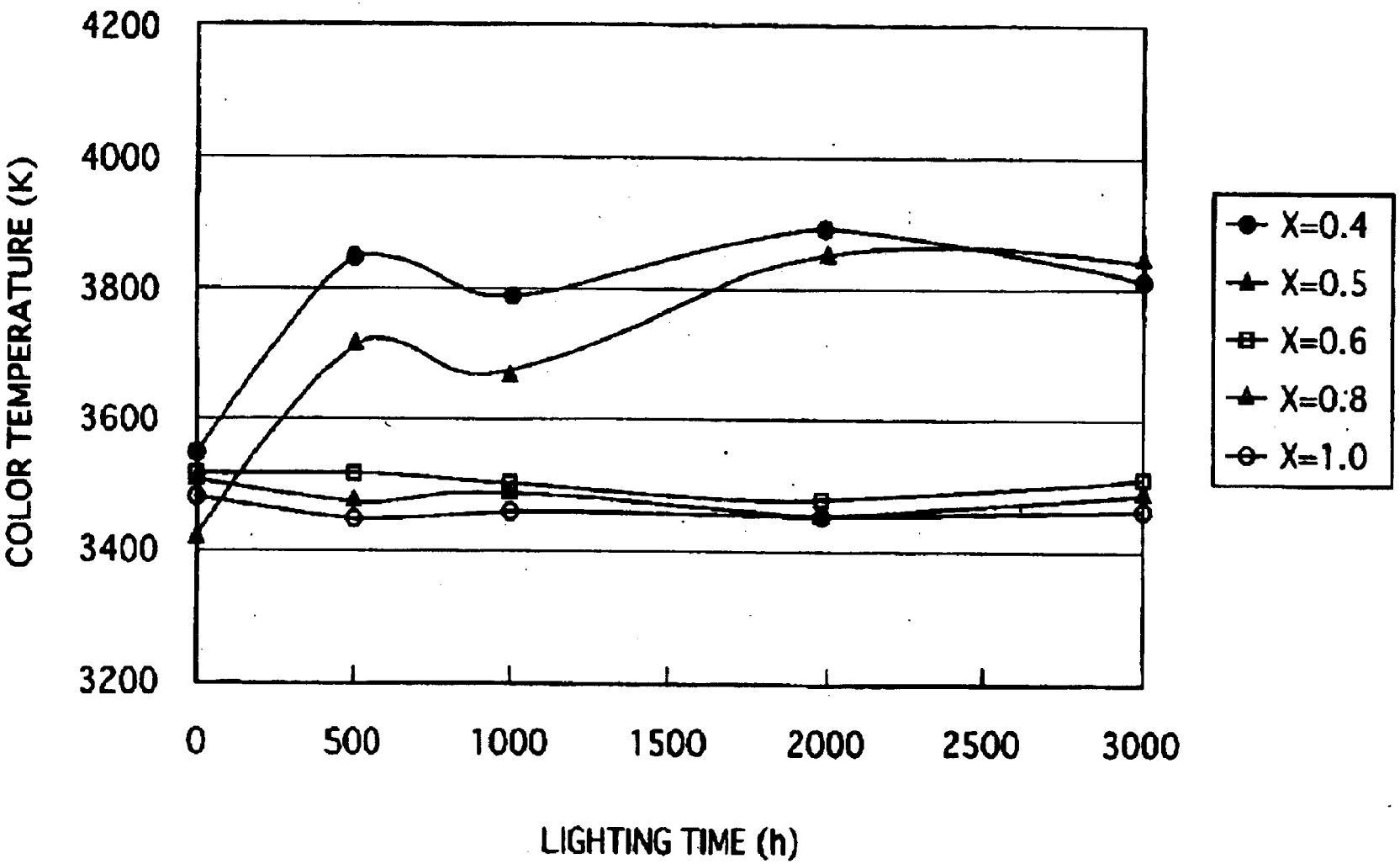
FIG. 6 is a graph showing a change in the color temperature in metal halide lamps (70 W) with the construction shown in FIGS. 2 and 3, each lamp varying in the distance "x" from one end of the coil facing the thin-tube unit to one end of the thin-tube unit facing the discharge space.
Figure 9:
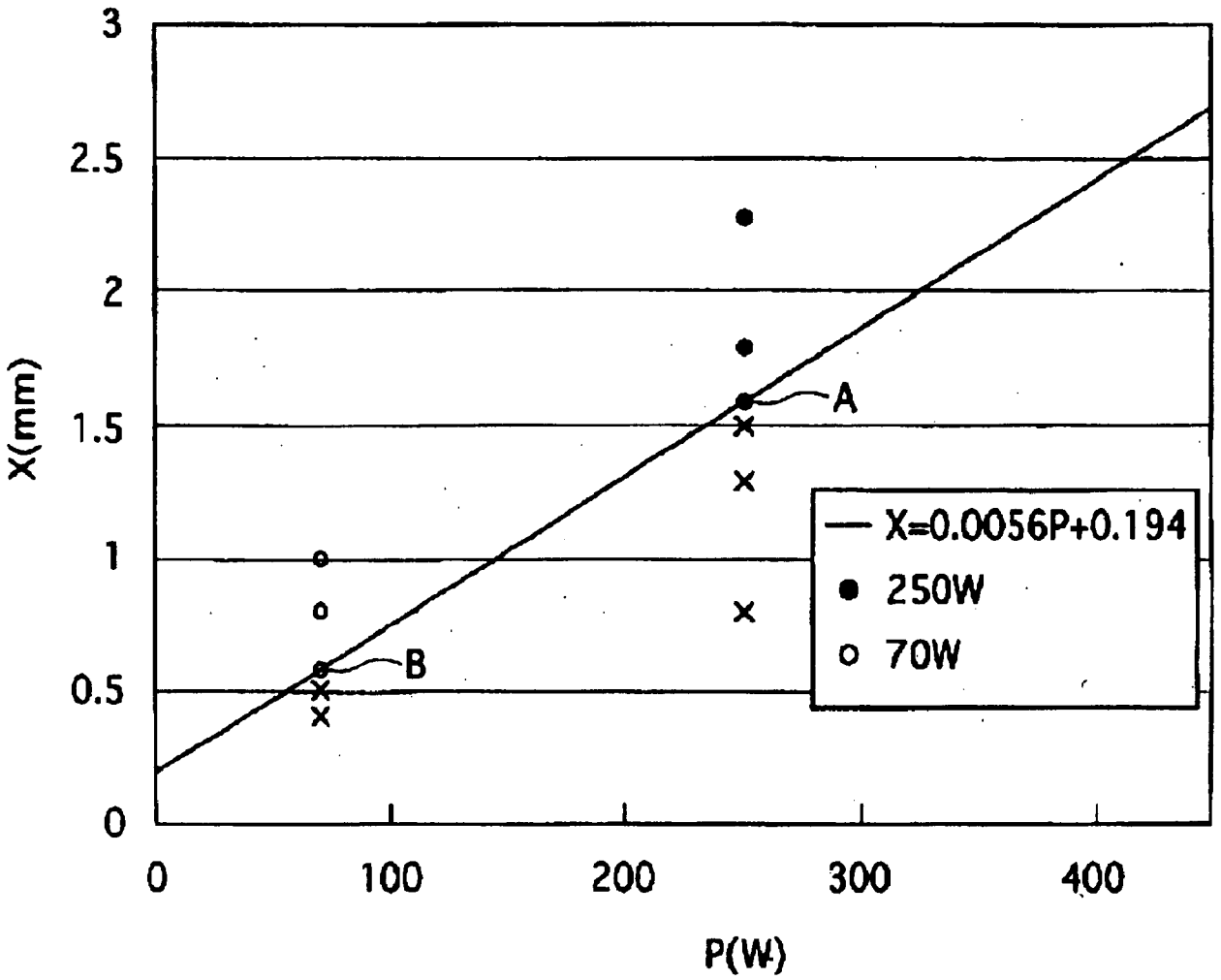
FIG. 9 is a graph plotting the test results shown in FIGS. 7 and 8, to obtain the relationship between the distance "X" and the lamp wattage "P"

To be more specific, a plurality of 70 W test lamps were prepared for this test, with the distance "X" being set at various values, namely, 0.4 mm, 0.5 mm, 0.6 mm, 0.8 mm, and 1.0 mm. For each lamp, a change in its color temperature during the life was measured. The test results are shown in FIG. 6.

It should be noted here that the other specifications of each test lamp were uniformly set in the following way.

The length "L" of parts of the tubular members 14*a* and 14*b* protruding into the discharge space 1 was uniformly set at 0.1 mm.

The amount of light-emitting metal enclosed in the discharge space 1 was uniformly set at 2.5 mg. The light-emitting metal composed of 0.4 mg of $DyI_3$, 0.3 mg of $HoI_3$, 0.4 mg of $TmI_3$, 1.1 mg of NaI, and 0.3 mg of TlI was used. Within the discharge space 1, 20 kPa of argon was enclosed as a rare gas. Further, the distance "Y" from one ends of the thin-tube units 3*a* and 3*b* facing the discharge space 1 to one ends of the glass frit sealing members 7*a* and 8*b* closer to the discharge space 1 was uniformly set at 8 mm.

FIG. 8 is a table showing the color temperature change (ΔTc) after 3000 hours of lighting. The table shows values of the color temperature change that are derived from the test results in FIG. 6, together with their evaluation.

As can be known from the figure showing the case of 70 W test lamps, the color temperature change during lighting is extremely small for the lamps with the distance "X" being 0.6 mm or more. These results can be explained in the same manner as that for the 250 W metal halide lamps, i.e., the amount of light-emitting metal flowing into the thin-tube units 3*a* and 3*b* is reduced.

The test results for the 250 W and 70 W metal halide lamps reveal that optimum values for the distance "X" differ depending on the lamp wattage "P".

To be more specific, the larger the lamp wattage "P", the more the heat generated. To lower the temperature of the ends of the thin-tube units facing the discharge-space to such a degree that an excess of metal can exist in a liquid form, the distance "X" is to be set large accordingly. This indicates that a certain correlation exists between the optimum range of values for the-distance "X" and the lamp wattage "P".

To find such a correlation, values of (X, P) in the tables shown in FIGS. 7 and 8 are plotted in the coordinate system with the horizontal axis showing the lamp wattage "P [W]"and the vertical axis showing the distance "X [mm]". In this coordinate system, points A and B—the smallest values for the distance "X" that can produce the effect of reducing the color temperature change (X=1.6 for 250 W lamp, and X=0.6 for 70 W lamp as described above)—are linked. An equation of the straight line linking the points is written as "X=0.0056P+0.194".

To sum up, in the case of 250 W and 70 W metal halide lamps, the color temperature change can be reduced when $X \geqq 0.0056P+0.194$ (hereafter, this condition is referred to as the "first optimization condition").

(2) Optimum Range for Length "L"

Next, a lighting test was conducted on metal halide lamps (250 W) with the construction shown in FIGS. 2 and 3, for the purpose of finding an optimum range of values for the length "L". For this test, a plurality of test lamps were prepared, with the length "L" being set at various values, namely, −0.2 mm (i.e., the tubular members 6*a* and 6*b* are recessed from the ends of the thin-tube units 3*a* and 3*b* facing the discharge space by a length of 0.2 mm), −0.1 mm, 0 mm, and 0.5 mm. For each lamp, a change in its color temperature during the life was measured. The test results are shown in the table in FIG. 10. In the table, "ΔTc" indicates a value for the color temperature change after lighting of 3000 hours.

It should be noted here that the other specifications of each test lamp were uniformly set in the following way.

The distance "X" from one ends of the electrode coils 4*a* and 4*b* facing the thin-tube units 3*a* and 3*b* to one ends of the thin-tube units 3*a* and 3*b* facing the discharge space 1 was uniformly set at 1.6 mm.

The amount of light-emitting metal enclosed into the discharge space 1 was uniformly set at 5.2 mg. The light-emitting metal composed of 0.8 mg of $DyI_3$, 0.6 mg of $HoI_3$, 0.8 mg of $TmI_3$, 2.2 mg of NaI, and 0.8 mg of TlI was used. Within the discharge space 1, 20 kPa of argon was enclosed as a rare gas.

Further, the distance "Y" from one ends of the thin-tube units 3*a* and 3*b* facing the discharge space 1 to one ends of the glass frit sealing members 7*a* and 7*b* closer to the discharge space 1 was uniformly set at 18 mm. As can be known from the test results shown in FIG. 10, the color temperature change during lighting of long hours is extremely small for the test lamps with the length "L" being 0.5 mm or more. A range of values for the length "L" where the color temperature change is permissible in the 250 W metal halide lamps can be determined as $0 \leqq L$, considering that observers usually evaluate the color temperature change of around 300 K as being permissible.

To be more specific, particularly when $0<L$, a vapor pressure within the arc tube 8 can be maintained sufficiently high during lighting. Therefore, as compared with conventional lamps in which the tubular members 14*a* and 14*b* are not provided (with the distance "X" being 1.0 mm and the distance "Y" being 8 mm), the color temperature change of lamps with the length "L" being $0<L$, measured for example during lighting of 1000 hours, can be reduced to about a half of that of the conventional lamps. Further, the lamps can show the color temperature change during lighting of 3000 hours substantially comparable to the color temperature change during lighting of 1000 hours.

Next, the same test was conducted on 70 W metal halide lamps with the construction shown in FIGS. 2 and 3. For this test, a plurality of 70 W test lamps were prepared, with the length "L" being set at various values, namely, −0.2 mm, −0.1 mm, 0 mm, and 0.2 mm. For each lamp, a change in its color temperature during the life was measured. The test results are shown in the table in FIG. 11.

It should be noted here that the other specifications of each test lamp were uniformly set in the following way.

The distance "X" from one ends of the electrode coils 4*a* and 4*b* facing the thin-tube units 3*a* and 3*b* to one ends of the thin-tube units 3*a* and 3*b* facing the discharge space 1 was uniformly set at 0.6 mm. The amount of light-emitting metal enclosed in the discharge space 1 was uniformly set at 2.5 mg. The light-emitting metal composed of 0.4 mg of $DyI_3$, 0.3 mg of $HoI_3$, 0.4 mg of $TmI_3$, 1.1 mg of NaI, and 0.3 mg of TlI was used. Within the discharge space 1, 20 kPa of argon was enclosed as a rare gas. The distance "Y" from one ends of the thin-tube units 3*a* and 3*b* facing the discharge space 1 to one ends of the glass frit sealing members 7*a* and 7*b* closer to the discharge space 1 was uniformly set at 8 mm.

As can be known from the test results in FIG. 11, the 70 W test lamps show the following color temperature change as is the case with the 250 W lamps. The color temperature change is extremely large for the lamps with the length "L" being set at a negative value. The color temperature change then for the first time falls within a substantially permissible range, which is below around 300 K, for the lamps with the length "L" being set at zero. The color temperature change is extremely small for the lamps with the length "L" being set at a positive value.

Here, a large number of such metal halide lamps whose distance "X" satisfies the first optimization condition were prepared, and the same test was conducted on these lamps with the length "L" being varied. The similar results as above were obtained.

Accordingly, it can be concluded that 250 W and 70 W metal halide lamps whose distance "X" satisfies the first optimization condition and the length "L" being set at 0 or more ($0 \leqq L$) can show a permissible level of color temperature change after lighting of long hours. As described above, better results are obtained when $0<L$.

Although it is preferable to set the length "L" at a larger value, this does not mean that the length "L" can be set as long as possible. With the length "L" being too long, an arc discharge may be generated at wrong positions. To be more specific, at the time of lamp startup, an arc discharge may start from the tubular members 14*a* and 14*b*, instead of from the electrode coils 4*a* and 4*b*. Such a wrong arc discharge is hereafter referred to as "back arc".

The back arc is unfavorable because if the back arc occurs, metal may be scattered from where the discharge starts (here, the tubular members 14*a* and 14*b*), blackening the inner wall of the light-emitting unit 2. Further, the arc heat may cause cracking in parts of the light-emitting unit 2 or the thin-tube units 3*a* and 3*b* that are in the vicinity of where the discharge starts.

In view of such disadvantages, a test for examining the probability of the back arc at the lamp startup was conducted on 250 W metal halide lamps with the construction shown in FIGS. 2 and 3. For this test, a plurality of 250 W test lamps were prepared, with the length "L" being set at various values, namely, 0 mm, 0.1 mm, 0.5 mm, 0.7 mm, 0.8 mm, and 0.9 mm, and the probability of the back arc at the lamp start lamp was examined for each lamp. The test results are shown in the table in FIG. 12.

It should be noted here that as to the type and amount of gas and light-emitting metal to be enclosed and values for the distance "X" and "Y", the same specifications as those employed in the test shown in FIG. 10 were employed for these test lamps.

As shown in the table in FIG. 12, the back arc at the lamp startup was observed in two or more of the ten lamps with the length "L" being set at 0.8 mm and more. The back arc was observed in none of the lamps with the length "L" being set at 0.7 mm and less.

These results can be explained as follows. With the length "L" being set at 0.8 mm or more, the length of parts of the tubular members 14*a* and 14*b* protruding into the discharge space 1 is so long that causes a discharge to start from the ends of the tubular members 14*a* and 14*b* facing the discharge space 1.

Next, the same test for examining the probability of the back arc at the lamp startup was conducted on 70 W metal halide lamps with the construction shown in FIGS. 2 and 3.

For this test, a plurality of test lamps were prepared, with the length "L" being set at various values, namely, 0 mm, 0.1 mm, 0.2 mm, 0.25 mm, 0.3 mm, and 0.4 mm, and the probability of the back arc at the lamp start lamp was examined for each lamp. The test results are shown in the table in FIG. 13.

It should be noted here that as to the type and amount of gas and light-emitting metal to be enclosed and values for the distance "X" and "Y", the same specifications as those employed in the test shown in FIG. 11 were employed for these test lamps.

As shown in the table in FIG. 13, the back arc at the lamp startup was observed in two or more of the ten lamps with the length "L" being set at 0.3 mm and more. The back arc was observed in none of the lamps with the length "L" being set at 0.25 mm and less.

These results can be explained in the same manner as that for the 250 W metal halide lamps, i.e., the back arc is likely to occur when the length "L" of parts of the tubular members 14*a* and 14*b* protruding into the discharge space 1 is too long.

The probability of the back arc is considered to increase as the length "L" increases. This may be because the distance between (a) the ends of the tubular members 14*a* and 14*b* facing the discharge space and (b) the electrode coils 4*a* and 4*b* decreases as the length "L" increases, and the probability of the back arc increases along with the above distance decrease. If this is the case, a certain correlation can be established between the back arc probability and the distance "X" and the length "L".

To find such a correlation, values of the test results in FIGS. 12 and 13 are plotted using test data of the 250 W metal halide lamps (X=1.6) and test data of the 70 W metal halide lamps (X=0.6), in the coordinate system with the horizontal axis showing the distance "X [mm]" and the vertical axis showing the length "L [mm]".

Figure 14:
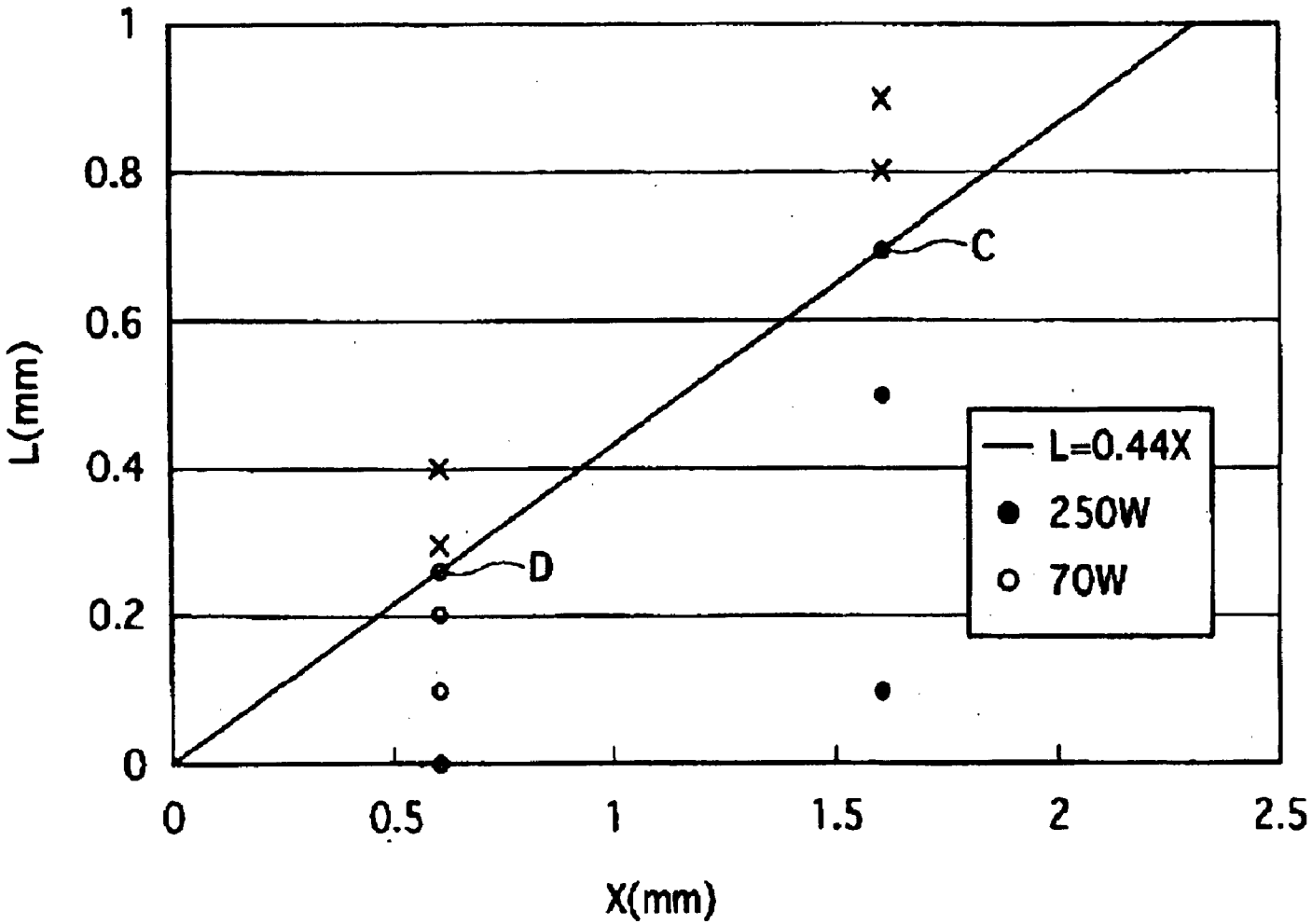
FIG. 14 is a graph plotting the test results shown in FIGS. 12 and 13, to obtain the relationship between the distance "X" and the length "L"

In the graph shown in FIG. 14, a "cross" indicates a point showing a value of the length "L" for which the back arc was observed among the ten test lamps, a "black dot" or "white dot" indicates a value of the length "L" for which the back arc was not observed among the ten test lamps.

Here, for test data of each lamp wattage, points C and D—the largest values for the length "L" for which the back arc was not observed—are linked. An equation of the straight line linking the points is written as "L=0.44X".

Accordingly, in the case of 250 W and 70 W metal halide lamps with the distance "X" being set at particular values, the back arc does not occur when $L \leqq 0.44X$.

The test for examining the probability of the back arc was conducted on 250 W and 70 W metal halide lamps, with the distance "X" being set at various other values in such a range that can satisfy the above first optimization condition. The test results reveal that the back arc can be prevented also in lamps with the distance "X" being set at other values, as long as the lamps satisfy the above condition "$L \leqq 0.44X$".

Accordingly, it can be concluded that for 250 W and 70 W metal halide lamps, the back arc can be usually prevented by satisfying the condition "$L \leqq 0.44X$".

As described above, the color temperature change can be reduced when lamps have the distance "X" satisfying the first optimization condition and the length "L" being $0 \leqq L$. Therefore, by combining this condition with the condition "$L \leqq 0.44X$", an optimum range of values for the length "L" can be determined as "$0 \leqq L \leqq 0.44X$" (hereafter this condition for the length "L" is referred to as the "second optimization condition").

As described above, the first optimization condition ($X \geqq 0.00\,56P+0.194$) and the second optimization condition ($0 \leqq L \leqq 0.44X$) are to be satisfied, where "P [W]" represents the lamp wattage, "X [mm]" represents the distance from one ends of the thin-tube units 3*a* and 3*b* facing the discharge space 1 to one ends of the electrode coils 4*a* and 4*b* facing the thin-tube units 3*a* and 3*b*, and "L [mm]" represents the length of parts of the tubular members 14*a* and 14*b* protruding into the discharge space 1. By employing such optimization conditions, metal halide lamps within a permissible range of change in their color temperature during the life and without causing the back arc can be obtained, regardless of wattages (250 W and 70 W) of the lamps.

To be more specific, the amount of light-emitting metal flowing into the gap "λ" in the thin-tube unit 3*a* (or 3*b*) that is the lower one when the lamp is lit with being oriented in the vertical direction can be reduced. In this case, a sufficiently high vapor pressure of the light-emitting metal can be obtained, thereby narrowing a difference in the vapor pressure between (a) when the lamp is lit with being oriented in the vertical direction and (b) when the lamp is lit with being oriented in the horizontal direction. Accordingly, a metal halide lamp with a reduced change in its color temperature regardless of the lighting orientation can be obtained.

The above embodiment specifically shows measurement results for 250 W metal halide lamps and 70 W metal halide lamps. The same tests were also conducted on lamps with lamp wattages ranging from a low wattage of 35 W to a high wattage of 400 W. The test results confirm that the color temperature change during lighting can be reduced and the back arc can be prevented also for the lamps with various lamp wattages by satisfying the above first and second conditions.

Accordingly, the above first and second optimization conditions can be applied to almost all metal halide lamps for practical use, so as to realize stable lighting characteristics.

It should be noted here that although the first optimization condition does not specifically set the upper limit for the distance "X", the upper limit for the distance "X" can be determined automatically according to the size of a bulb for the arc tube and the distance between electrodes, which, are determined according to the lamp wattage of the metal halide lamp.

(Modified Examples)

Figure 15:
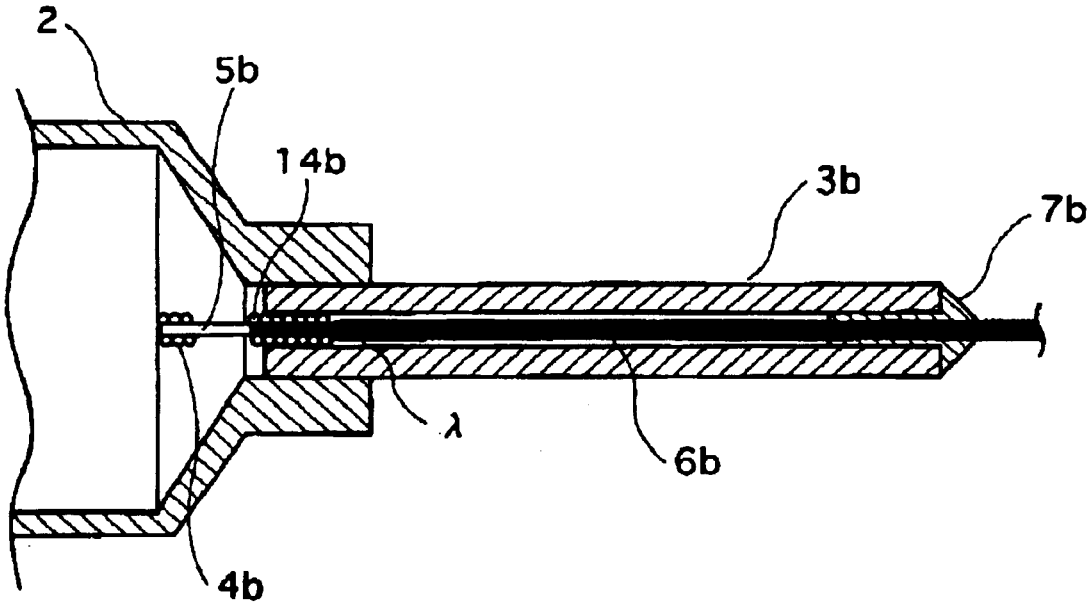
FIG. 15 is a partially enlarged sectional view showing the construction of an arc tube relating to a modified example of the present invention.

(1) The above embodiment describes the case where the tubular members 14*a* and 14*b* are set on the electrode pins 5*a* and 5*b* so as to cover only the base ends of the electrode pins 5*a* and 5*b*. Here, there may be a case where the electrode holding members 6*a* and 6*b* are so long as to extend into the discharge space. In such a case, the diameter of an end part of the electrode holding member 6*b* may be reduced, and the tubular member 14*b* may be set to cover this electrode holding member end part with the reduced diameter as shown in FIG. 15. The same applies to the thin-tube unit 6*a*.

Figure 16:
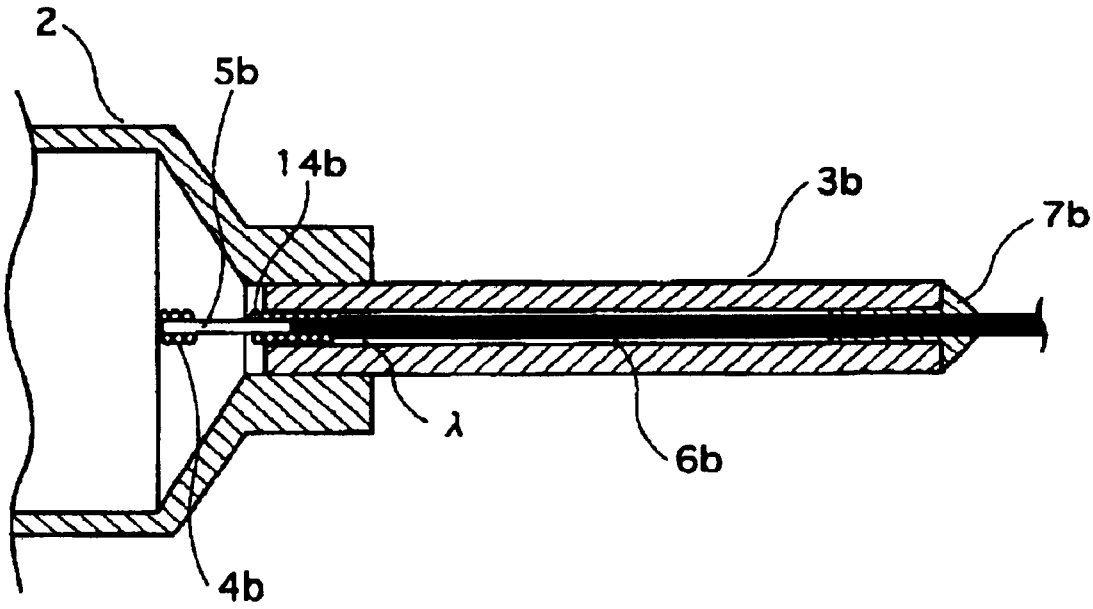
FIG. 16 is a partially enlarged sectional view showing the construction of an arc tube relating to another modified example of the present invention.

Further, the tubular member 14*b* may be set to cover both the electrode pin 5*b* and the electrode holding member 6*b* as shown in FIG. 16. In this case, too, the same effect as described above can be produced. The same applies to the thin-tube unit 6*a*.

It should be noted here that the electrode holding member 6*b* is painted all black in FIGS. 15 and 16 to clearly show its top part. (2) Although the above embodiment describes the case where coil members formed by densely turning a metal wire such as a molybdenum wire are used as the tubular members 14*a* and 14*b*, other members made of a heat-proof and heat-conductive material such as tungsten may instead be used as the tubular members 14*a* and 14*b*.

Figure 17:
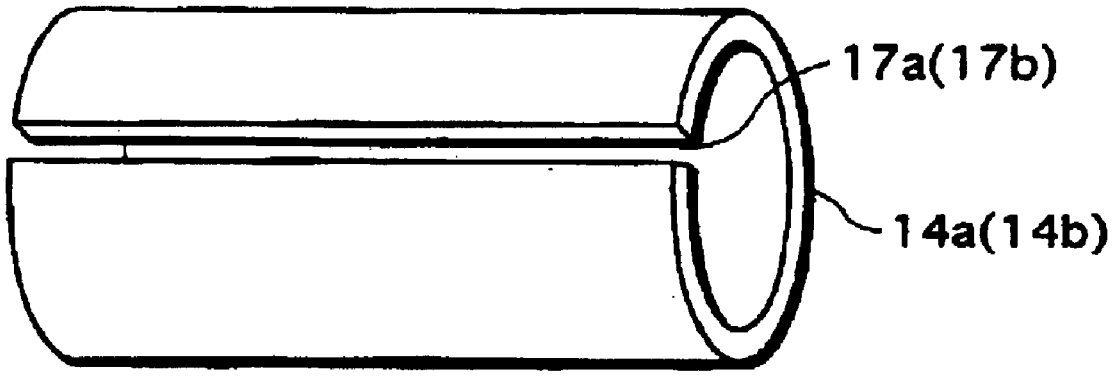
FIG. 17 is a perspective view showing a modified example of a tubular member in the arc tube of the present invention.

Also, the tubular members 14*a* and 14*b* may not be coil members but may be in any other forms as long as they can occupy the gaps formed at the inner wall of the thin-tube units. Further, as shown in FIG. 17, a part 17*a* (17*b*) of the tubular member 14*a* (14*b*) may be cut out in the tube axis direction as necessary. In this case, too, the same effect as described above can be produced.

The tubular members 14*a* and 14*b* with these cut-out parts 17*a* and 17*b* can be set easily on the electrode pins 5*a* and 5*b* or on the electrode holding members 6*a* and 6*b*. Therefore, the operation of setting the tubular members 14*a* and 14*b* can be simplified, thereby improving the productivity.

Further, instead of metal, conductive cermet may be used as a material for the tubular members. (3) Although the above embodiment describes the case where the arc tube (see FIG. 3) formed by shrinkage-fitting the thin-tube units 3*a* and 3*b* to the light-emitting unit 2 is used, the same optimization conditions as above can also be derived for an arc tube made by integrally forming a light-emitting unit and thin-tube units.

Figure 18:
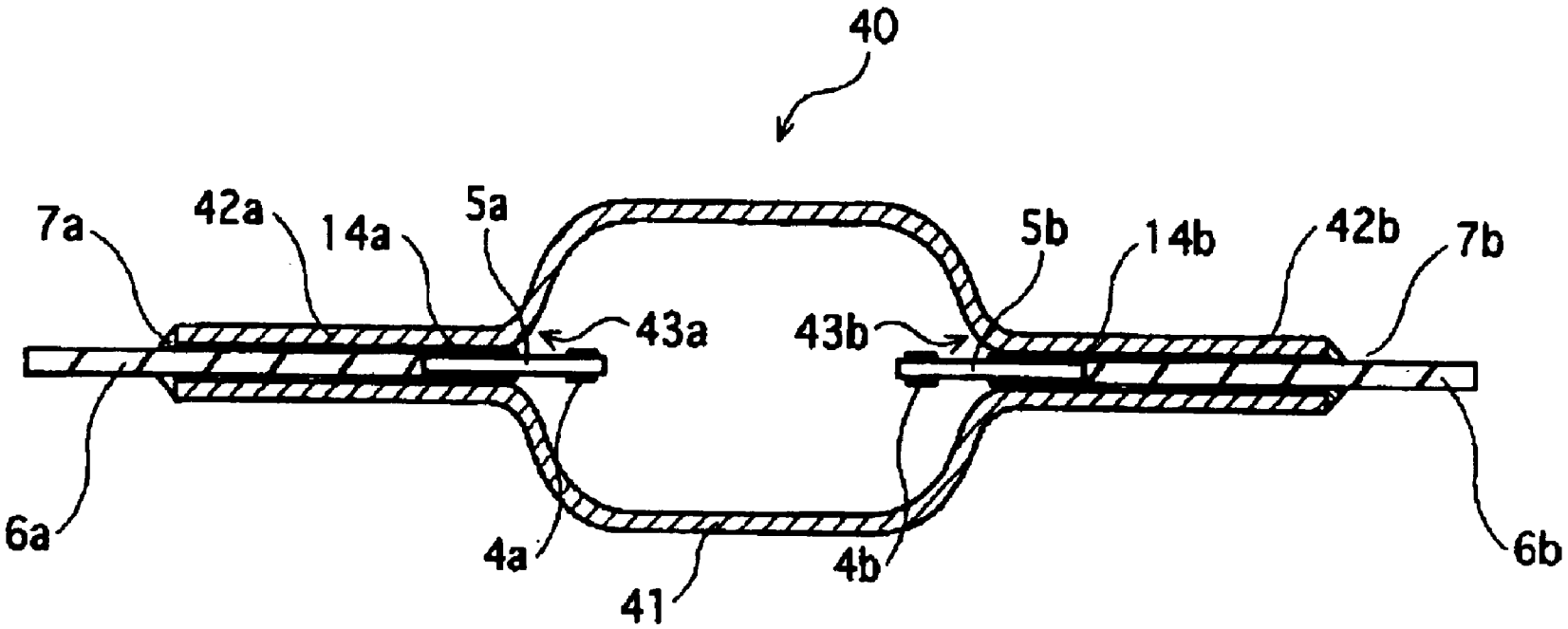
FIG. 18 is across sectional view showing the construction of an arc tube relating to still another modified example of the present invention.

FIG. 18 is across sectional view showing the construction of an arc tube 40 with such an integral construction. As shown in the figure, the arc tube 40 is made up of a light-emitting unit 41 and thin-tube units 42*a* and 42*b* that are integrally formed. Funnel-shaped parts 43*a* and 43*b* join the thin-tube units 42*a* and 42*b* to the light-emitting unit 41. Therefore, this arc tube 40 does not have such parts that match the ends of the thin-tube units 3*a* and 3*b* facing the discharge space in the arc tube 8 shown in FIG. 3, which are used as the reference for measuring the above distance "X" and the length "L".

Figure 19:
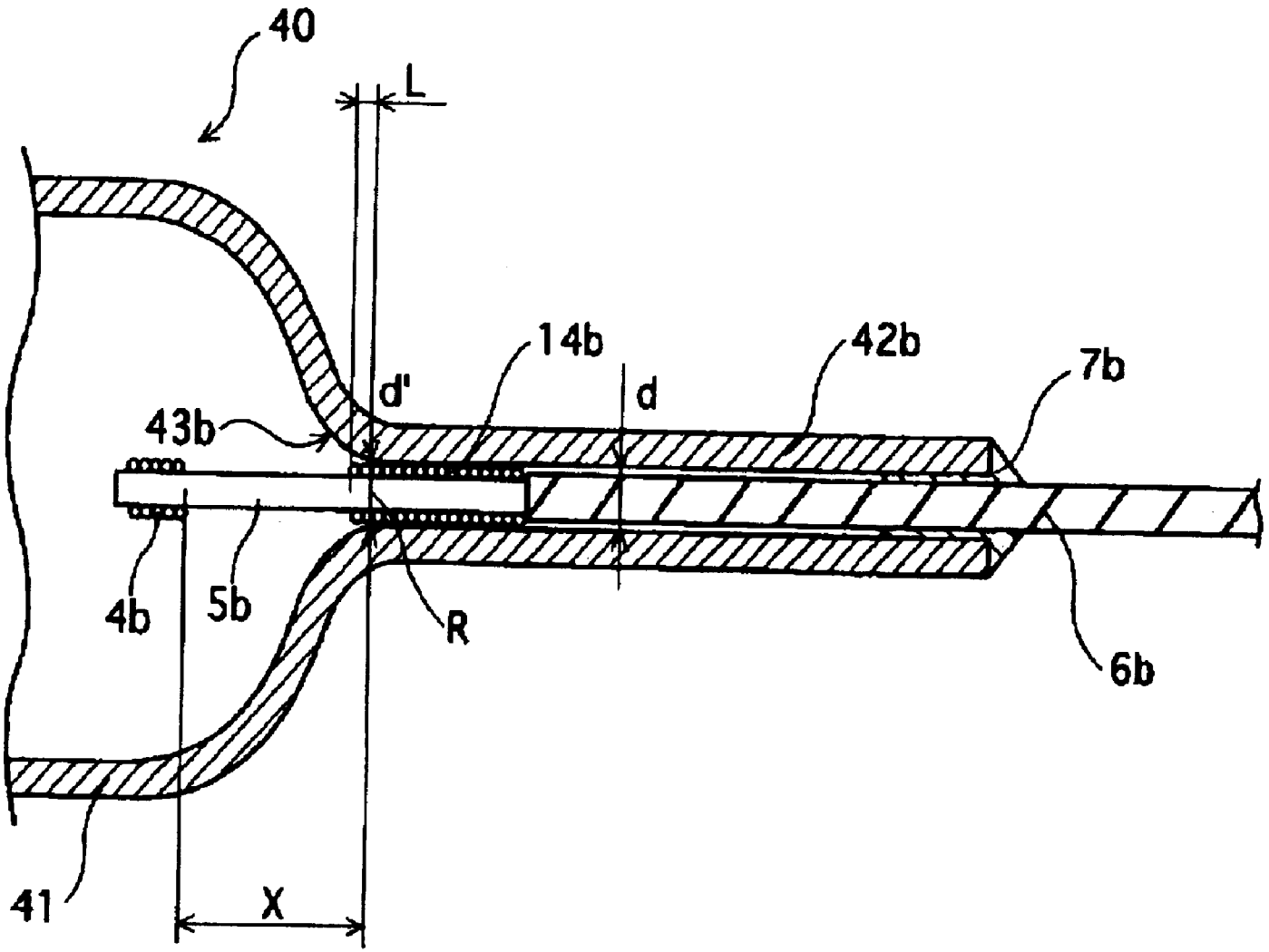
FIG. 19 is a partially enlarged sectional view showing a detailed construction of one thin-tube unit of the arc tube in FIG. 18.

In the present modified example, tests were conducted to confirm the following. In the funnel part 43*b* shown in the partially enlarged view in FIG. 19, a position "R", in the tube axis direction, at the funnel part 43*b* where its internal diameter "d'" is 1.25 times the inner diameter of the thin-tube unit 42*b*, is determined as the reference position. The distance "X and the length "L " can be measured from this reference position "R". In this way, the optimization conditions obtained for the arc tube 8 shown in FIG. 3 (namely, "$X \geqq 0.0056P+0.194$" and "$0 \leqq L \leqq 0.44X$") can be directly applied to the arc tube 40 with the integral construction. The same applies to the funnel part 43*a*.

(4) As described above, the light-emitting metal flows into the gap "λ" particularly in the lower thin-tube unit when the metal halide lamp is lit with the tube axis being oriented in the vertical direction. If this is the case, the above tubular member may not be provided in both the thin-tube units but may be provided only in the lower one of the thin-tube units when the orientation of the lamp for use is limited to one side.

However, when the orientation of the lamp for use is not limited to one side, it is difficult to determine at the assembly stage, which one of the thin-tube units is to be oriented downward by the user. In view of this, it is preferable to provide the tubular member in each of the thin-tube units as in the above embodiment and to set the distance "X" and the length "L" in each thin-tube unit so as to satisfy both the first and second optimization conditions.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A metal halide lamp, comprising:

a bulb that is made up of a light-emitting unit in which a discharge space is formed, and a pair of thin-tube units each being fitted into an opening in a different one of both ends of the light-emitting unit;

a pair of electrodes that extend into the discharge space so that tops thereof are opposed to each other, each electrode having an electrode coil at a top part thereof;

a pair of electrode holding members each being provided through a different one of the thin-tube units so that one end thereof holds the electrode and the other end thereof extends from one end of the thin-tube unit not facing the discharge space, each electrode holding member being sealed to the thin-tube unit via a sealing member;

a tubular member that is provided in at least one of the thin-tube units, so that the electrode and/or the electrode holding member therein is inserted through the tubular member, the tubular member being made of a heat-proof and heat-conductive material, wherein the expressions $X \geqq 0.0056P+0.194$ and $0 \leqq L \leqq 0.44X$ are satisfied, where "P" is a lamp wattage [W], "X" is a distance [mm] from one end of the thin-tube unit facing the discharge space to one end of the electrode coil facing the thin-tube unit, and "L" is a length [mm] of a part of the tubular member protruding from the end of the thin-tube unit facing the discharge space into the discharge space.

2. The metal halide lamp of claim 1, wherein the tubular member is a coil.

3. The metal halide lamp of claim 2, wherein the tubular member is a densely turned coil without any gaps formed between adjacent turns.

4. The metal halide lamp of claim 1, wherein one end of the tubular member not facing the discharge space is substantially in contact with the electrode holding member.

5. The metal halide lamp of claim 1, wherein a part of the tubular member is cut out in a tube axis direction.

6. The metal halide lamp of claim 1, wherein the tubular member is made of one metal selected from molybdenum and tungsten.

7. The metal halide lamp of claim 1, wherein the light-emitting unit is made of translucent ceramic.

8. A metal halide lamp, comprising:

a bulb that is integrally made up of a light-emitting unit in which a discharge space is formed, and a pair of thin-tube units;

a pair of electrodes that extend into the discharge space so that tops thereof are opposed to each other, each electrode having an electrode coil at a top part thereof;

a pair of electrode holding members each being provided through a different one of the thin-tube units so that one end thereof holds the electrode and the other end thereof extends from one end of the thin-tube unit not facing the discharge space, each electrode holding member being sealed to the thin-tube unit via a sealing member;

a tubular member that is provided in at least one of the thin-tube units, so that the electrode and/or the electrode holding member therein is inserted through the tubular member, the tubular member being made of a heat-proof and heat-conductive material, wherein the expressions $X \geqq 0.0056P+0.194$ and $0 \leqq L \leqq 0.44X$ are satisfied, where "P" is a lamp wattage [W], "X" is a distance [mm] from a reference position to one end of the electrode coil facing the thin-tube unit, and "L" is a length [mm] of a part of the tubular member protruding from the reference position into the discharge space, the reference position being a position on a joining part of the light-emitting unit joining each thin-tube unit thereto, where an inner diameter of the joining part is 1.25 times an inner diameter of the thin-tube unit.

9. The metal halide lamp of claim 8, wherein the tubular member is a coil.

10. The metal halide lamp of claim 9, wherein the tubular member is a densely turned coil without any gaps formed between adjacent turns.

11. The metal halide lamp of claim 8, wherein one end of the tubular member not facing the discharge space is substantially in contact with the electrode holding member.

12. The metal halide lamp of claim 8, wherein a part of the tubular member is cut out in a tube axis direction.

13. The metal halide lamp of claim 8, wherein the tubular member is made of one metal selected from molybdenum and tungsten.

14. The metal halide lamp of claim 8, wherein the light-emitting unit is made of translucent ceramic.

* * * * *